United States Patent [19]

Saruwatari

[11] Patent Number: 4,965,779

[45] Date of Patent: Oct. 23, 1990

[54] MULTI-FUNCTIONAL ELECTRONIC TIMEPIECE

[75] Inventor: Tomozumi Saruwatari, Tokyo, Japan

[73] Assignee: Seiko Instruments Inc., Japan

[21] Appl. No.: 427,038

[22] Filed: Oct. 25, 1989

[30] Foreign Application Priority Data

Oct. 25, 1988 [JP] Japan ..... 63-268573

[51] Int. Cl.[5] ..... G04B 19/04; G04B 21/00

[52] U.S. Cl. ..... 368/80; 368/273

[58] Field of Search ..... 368/76, 80, 75, 272-273

[56] References Cited

U.S. PATENT DOCUMENTS 4,397,565 8/1983 Ota ..... 368/242
4,421,420 12/1983 Ushikoshi ..... 368/229
4,474,480 10/1984 Kato ..... 368/272
4,531,841 7/1985 Puff ..... 368/82
4,730,284 3/1988 Adams ..... 368/272

*Primary Examiner*—Vit W. Miska
*Attorney, Agent, or Firm*—Bruce L. Adams; Van C. Wilks

[57] ABSTRACT

A multi-functional electronic timepiece has a melody function to play a musical piece and musical hand operation function to operate hands in a normal or reverse rotating direction in match with the sound emission. A plurality of basic hand operation patterns are prepared in a ROM and a predetermined number of basic hand operation patterns are selected in accordance with pattern selecting data which is easily able to change by manufacturer or user to operate hands in match with various musical pieces.

7 Claims, 4 Drawing Sheets

4 RAM

| A | B | C | D | E |
|---|---|---|---|---|
| S | N | | | |

MULTI-FUNCTIONAL ELECTRONIC TIMEPIECE

BACKGROUND OF THE INVENTION

This invention relates to a multi-functional electronic timepiece.

Attempts have been made conventionally to satisfy diversified needs of users by use of the operation of hands for the application other than the indication of the time, and one of the such attempt is described in Japanese Patent Laid-Open No. 104281/1985 with reference to an example in which the hands indicates the golf swing.

The specification which moves the hands in match with a music is one of the methods for satisfying the diversified needs. In U.S. patent application Ser. No. 281,081/88 which is subject to an obligation of assignment to the same assignee, the specification for moving the hands in accordance with the music is accomplished by a method using a 2-chip structure consisting of a melody IC, which generates acoustic signals of melodies and tones of a musical piece which are in advance programmed, plays the music by a piezoelectric speaker or the like and is available commercially, and a microprocessor which accomplishes the timepiece specification by a program. In this case, a series of hand operations in match with the music are programmed in the microprocessor.

If a series of hand operations in match with the music are programmed as described above, the hand operations must be once again programmed or the hand operations for several musical pieces must be in advance programmed to cope with the case where a musical piece is changed.

In the case of the former, a microprocessor for each musical piece becomes necessary and this is of course very uneconomical. In the latter case, the capacity of ROM (Read-Only Memory) for storing the programs is consumed wastefully if the hand operation is merely programmed for each music and there exist the problems that efficiency of the program is low and freedom, too, is low.

SUMMARY OF THE INVENTION

It is therefore an object of the invention to provide a multi-functional electronic timepiece in which the hand is operated in match with a plurality of musical pieces by one processor with an efficient program to save ROM.

It is another object of the invention to provide a multi-functional electronic timepiece in which the hand operation is easily changed even when a musical piece is changed.

These and other objects of the present invention are accomplished by a multi-functional electronic timepiece which stores in advance a plurality of basic hand operation patterns in ROM, and selects sequentially the basic hand operation patterns by selecting means. In the multi-functional electronic timepiece having the construction described above, a plurality of basic hand operations are stored in advance in ROM simultaneously with the performance of musical piece and are selected and combined sequentially with one another by selecting means so as to operate the hands in either a normal or reverse rotating direction in match with the sound of the musical piece. Therefore, the selection of the hand operation patterns can be changed by the selecting means when the musical piece is changed, too, and the hand operations in match with a plurality of musical pieces can be attained by one microprocessor. Furthermore, since the hand operations are not stored for each musical piece, the capacity of ROM necessary for the hand operations does not increase even when the number of musical pieces increases.

DETAILED DESCRIPTION OF THE PREFERRED EMBODIMENT

Figure 1:
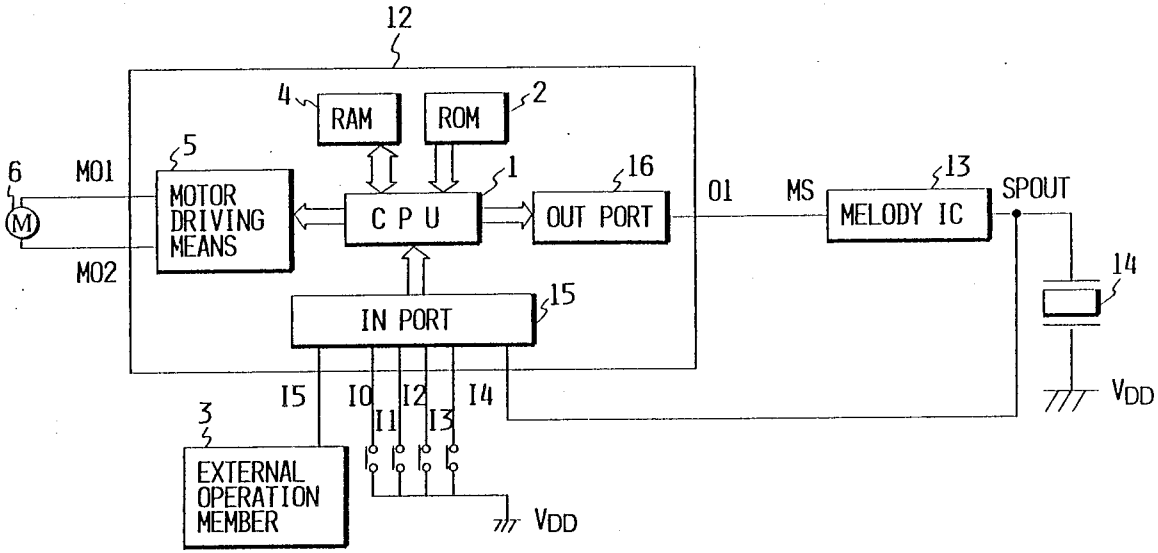
FIG. 1 is a structural view of one embodiment of the present invention.

Hereinafter, an embodiment of the present invention will be described with reference to the accompanying drawings. FIG. 1 shows an embodiment of the present invention. A microprocessor 12 consists primarily of processor means (hereinafter referred to as "CPU") 1, read-only memory means (hereinafter referred to as "ROM") 2, read/write memory means (hereinafter referred to as "RAM") 4, an IN port 15, an OUT port 16 and motor driving means 5. CPU 1 counts the time, drives a stepping motor 6 through the motor driving means 5 and processes a switch input from an external operation member 3 through the IN port 15 in accordance with the program stored in ROM 2. To this end are connected motor driving terminals M01 and M02 to the stepping motor 6, and the external operation member 3 is connected to an input terminal 15. The stepping motor 6 further moves hands (not shown) through a wheel train (not shown) so as to indicate the time and others. The data necessary for the processing by CPU 1 and the processing result are read and written from and into RAM 4. CPU 1 controls a melody IC 13 through the OUT port 16 is connected to the input terminal MS of the melody IC 13. When a high level signal is applied to the terminal MS, an acoustic signal is outputted from an SP OUT terminal and drives a piezoelectric speaker 14. The SP OUT terminal is also connected to the input terminal 14 of the microprocessor 12 so as to detect the start and end of buzzing. The microprocessor 12 has further 4-bit input terminals 10, I1, I2 and I3 and when each terminal is connected to a high level or low level, CPU 1 can read the 4-bit data through the IN port I5. The connection of the high or low level up to the input terminals I0–I3 can be easily attained by cutting a pattern on a circuit substrate.

Next, the operation will be explained. First of all, CPU 1 is under the WAIT state and waits for interruptions. When the interruptions occurs, CPU 1 starts processing in accordance with the program of ROM 2. CPU 1 includes the interruptions by the switch input entering through the IN port 15 and the interruption entering with a plurality of time periods. It will be hereby assumed that the interruptions of the periods of 1 Hz, 16 Hz, 32 Hz and 64 Hz exist and the acceptable state (open state) and the inhibition state (mask state)

can be selected individually for these interruptions in accordance with a software. Generally, CPU 1 sends every second a signal to the motor driving means 5 by the 1 Hz interruption, drives the stepping motor 6 and counts and displays the time. Next, when an input is applied by the external operation member 3, CPU 1 sends the signal to the melody IC 13 through the OUT port 16 so that the performance of a musical piece is started and motor driving is started in synchronism with the musical piece. During the motor is driven in synchronism with the musical piece, CPU 1 counts the number of the 1 Hz interruptions.

Figures 2, 3:
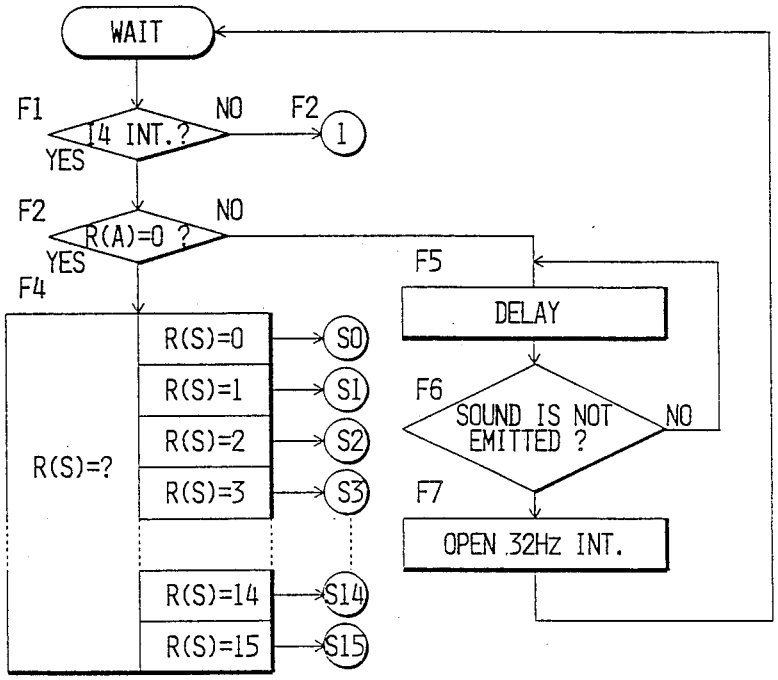
FIG. 2 is a RAM map in accordance with the present invention.
FIG. 3 is a part of a flowchart of the sequence for writing the hand operation data into RAM.

RAM 4 stores therein those data which represent how the stepping motor 6 is to be driven for each musical tone in the musical piece or in other words, a region for storing a hand operation patterns. Whenever each tone in the musical piece is complete in accordance with the value of this region, the stepping motor 6 is driven. FIG. 2 shows part of RAM 4. The regions A–E store the hand operation patterns, the region S stores 4-bit values from the input terminals I0–I3 and the region N is used as a counter. An initial value is set to RAM 4 at the time of initialization. The regions A–E and N are set to the initial value 0 and the region S is set to the values of the input terminals I0–I3. Five words from A to E are prepared for the hand operation pattern regions and one word has a 4-bit structure and can represent decimally the numeric values of from 0 to 15. The driving direction of the stepping motor 6 is judged from whether the most significant bit of the four bits constituting one word is 0 or 1. In other words, if the word represents less than 8 in decimal numeration, the stepping motor 6 is driven in the normal direction by that number and if it is 8 or more, the stepping motor 6 is driven reversely by the number as the difference of the number of the digit from 16. For instance, if the data 2, 14 and 2 are put into the regions A, B and C, the stepping motor 6 is driven in the sequence of the first tone—normal rotation by two steps—second tone—reverse rotation by two steps—third tone—normal rotation by two steps.

Figure 4:
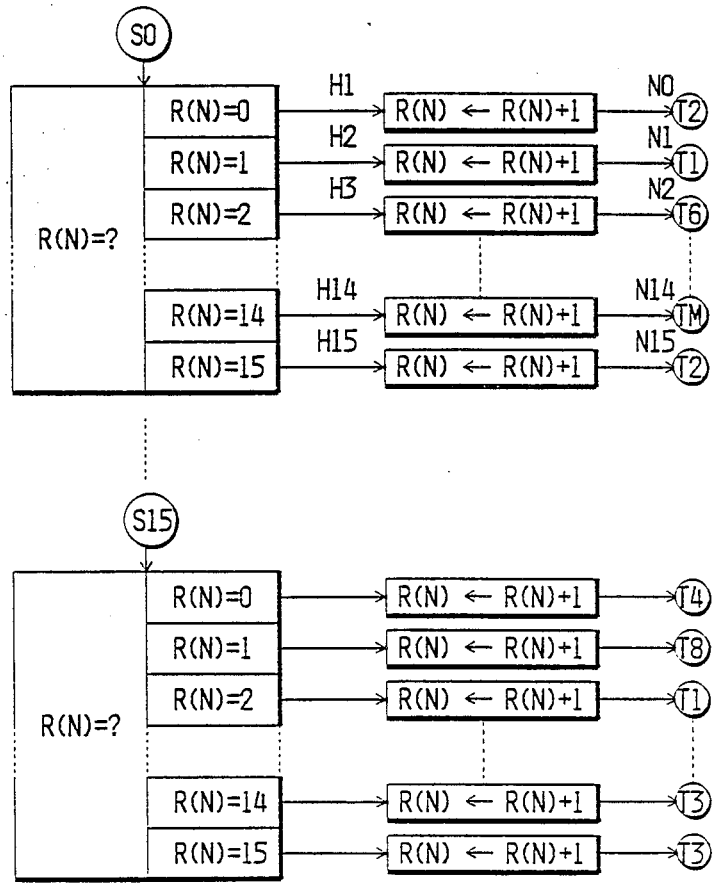
FIG. 4 is another part of the flowchart for writing the hand operation data into RAM.
Figure 5A:
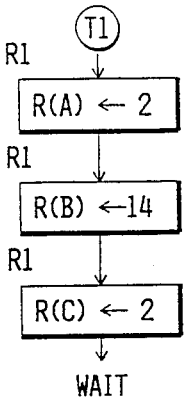
FIG. 5 is another part of the flowchart for writing the hand operation data into RAM.
Figure 5B:
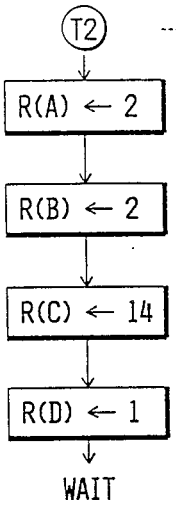
Figure 5C:
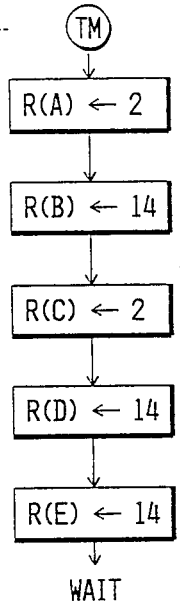

The hand operation pattern must be written into the regions A–E of RAM 4 in accordance with the progress of the musical piece. FIGS. 3, 4 and 5 show the writing sequence of the hand operation patterns.

In FIG. 3, CPU 1 is under the WAIT state. If there is the output of the acoustic signal from the SP OUT terminal, the interruption by I4 occurs and the start of buzzing of the sound is detected. At the processing step Fl, whether or not the interruption is that of I4 is judged. If it is the interruption by other causes, the flow branches to the step F2. If it is the interruption by I4, the flow proceeds to the step F3. The step F3 judges whether or not the hand operation pattern is set to RAM 4. In other words, if the value of the region A of RAM 4 is not 0, the flow proceeds to the step F4 by judging that the hand operation pattern exists. If the value is 0, the flow branches to the step F4, where the hand operation data is set. The step F4 makes branching of 16 ways of from S0 to S15 in accordance with the value of the region S of RAM 4. It branches to S0 if the value of the region S is 0 and to Sn if the latter is n. The steps F5 and F6 detect the start and end of buzzing of the sound. More definitely, the step F5 generates a delay time longer than one wavelength of the acoustic signal and the step F6 judges whether or not the interruption of I4 exists in the interim. If the interruption exists, the sound is judged as keeping buzzing and the flow returns again to the step F5, where the delay processing is made. If the interruption does not exist, the sound is judged as being complete and the flow branches to the step F7. At this step F7, the 32 Hz interruption is brought into the open state and returned to the WAIT state.

FIG. 4 shows the branch destination of the step F4. Here, the description will be made about the case where the flow branches to S0. The step G1 branches in 16 ways of H0 to H15 in accordance with the value of the region N. The region N is used as the counter for changing sequentially the branch destination from H0 to H15. Therefore, the value +1 is added from the step H0 to H15. Furthermore, the hand operation patterns are selected from the steps N0 to N15. FIG. 5 shows the data group of the hand operation patterns. In the case of the hand operation pattern T0, for example, the numeric value 2 is written into the region A of RAM 4 at the step R1, the value 14 is written into the region B at the step R2 and the value 2 is written into the region C at the step R3. The flow then returns again to the WAIT state. M patterns of from T0 to TM are prepared in advance as the hand operation patterns and are sequentially selected by the processing routine shown in FIG. 4.

Figure 6:
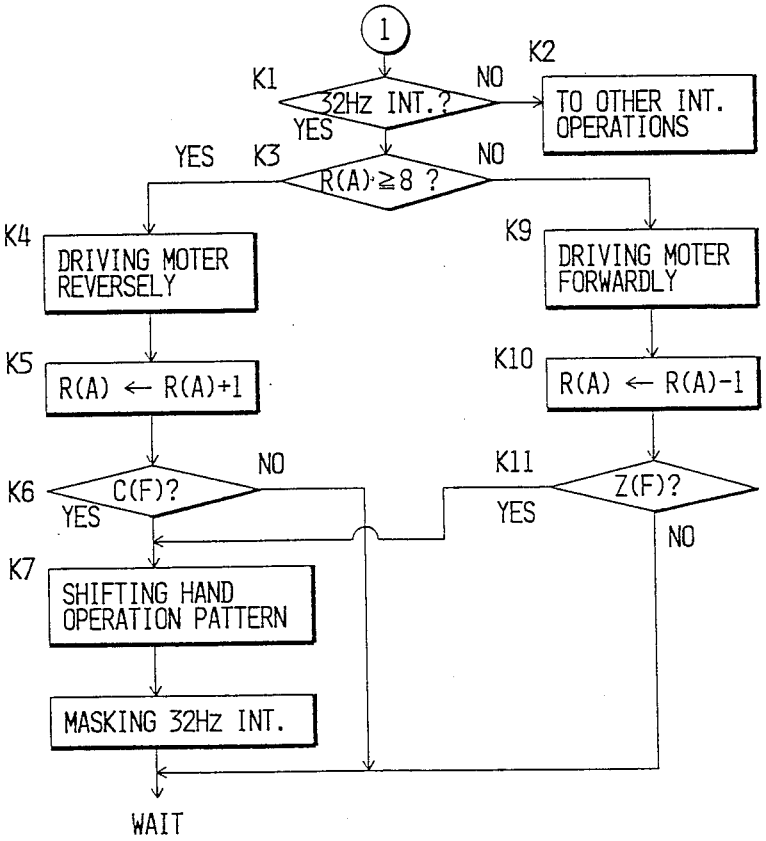
FIG. 6 is a flowchart of the driving sequence of the motor.

Next, the driving sequence of the motor is shown in FIG. 6. When the end of buzzing of the sound is detected at the step F6 of FIG. 3, the 32 Hz interruption is made open at the step F6. Therefore, the 32 Hz interruption is permitted from next. When this 32 Hz interruption is permitted, the flow branches to the step K1 of FIG. 6 through the steps Fl and F2. The step K1 judges if the interruption is the 32 Hz interruption or not. If the interruption is the one other than the I4 and 32 Hz interruptions, then the flow branches to the step K2. If it is the 32 Hz interruption, the flow proceeds to the step K3. This step K3 judges whether or not the value of the region A of RAM 4 is 8 or more. If its is 8 or more, the flow proceeds to the step K4 and the stepping motor 6 is driven reversely by one step. Next, +1 is added to the region A of RAM 4 at the step K5 and whether or not any carry exists is judged at the step K6. If the carry does not exist, the flow returns to the WAIT state and when the next 32 Hz interruption occurs, the steps are repeated in the sequence K1—K3—K4—K5—K6. Accordingly, the stepping motor 6 keeps reverse driving in the 32 Hz period until any carry is generated. If the carry exists at the step K6, the data of the hand operation patterns is shifted at the step K7. In other words, the value of the region B is shifted to A, C to B, D to C, E to D and 0 is put into E. Finally, the 32 Hz interruption is masked at the step K8 and the 32 Hz interruption is inhibited until the end of the next sound is detected once again. If the value of the region A is less than 8 at the step K3, the flow proceeds to the step K9, where the stepping motor 6 is driven for normal rotation. The step K10 reduces the value of the region A of RAM by 1 and the step K11 judges whether or not the value of the region A becomes zero. If it is not zero, the flow returns to the WAIT state and if it is zero, the steps K7 and K8 are carried out. Accordingly, the stepping motor 6 keeps normal driving until the value of the region A becomes zero.

RAM 4 also has areas for storing the hand position data and time information respectively. The hand position data is rewritten in accordance with the motor driving signal to represent a present hand position. On the other hand, the time information is rewritten in accordance with 1 Hz interruption to represent the present time. Hence, even after the hand has irregularly moved in synchronism with the melody, it is possible to invariably return the hand to indicate the present time by controlling the stepping motor driving means so that the hand position data coincides with the time information.

As described above, the present invention can accomplish the hand operation in match with the musical piece and can easily change the mode of the hand operation in match with the change of the musical pieces by the combination of the high or low level of the input terminals I0 to I3. Accordingly, the present invention makes it possible to mass-produce a wide variety of products. Since the hand operation for each musical piece is carried out by selecting and combining suitably a plurality of hand operation patterns prepared in advance in ROM, the ROM capacity can be saved more greatly than when the hand operation for each musical piece is stored in ROM.

What is claimed is:

1. A multi-functional electronic timepiece having hands for analog indication and motor means to drive the hands comprising;

timekeeping means for keeping a present time including commanding means for generating a melody starting command signal;

motor driving means for driving said motor means;

acoustic means responsive to input of said melody starting command signal for emitting a sound having a predetermined rhythm, having speaker means for audible sound emission; and means for controlling said motor driving means so that said time indication means is driven in a different way from normal time indication in synchronism with said sound emission having a capacity for storing a plurality of basic hand operation patterns and means for selecting a predetermined number of said basic hand operation patterns.

2. An analog electronic timepiece as claimed in claim 1 wherein said timekeeping means has storing means for storing a timekeeping program and processing means for executing said timekeeping program.

3. An analog electronic timepiece as claimed in claim 1 wherein said acoustic means has means for outputting rhythm signal.

4. An analog electronic timepiece as claimed in claim 1 wherein said selecting means has a capacity for storing hand operation data in accordance with the selected basic hand operation pattern.

5. An analog electronic timepiece as claimed in claim 1 wherein said controlling means has an input port for receiving basic pattern selecting data and said selecting means has means for selecting a predetermined number of said basic hand operation patterns on the basis of the inputted basic pattern selecting data.

6. An analog electronic timepiece as claimed in claim 1 further comprising recovering means responsive to said timekeeping means for controlling said motor driving means so that said hands indicates a present time after the sound emission.

7. An analog electronic timepiece having motor means and a plurality of hands driven by said motor means for analog indication comprising;

melody circuit means for playing music by generating acoustic signals associated with melodies and tones of a previously programmed composition, having output circuit for outputting electrical signals exhibiting timings of acoustic outputs; and timekeeping means for keeping a present time, having a processing means, read only memory for storing a time keeping program and a melody indication program including capacity for storing a plurality of basic hand operation patterns and selecting program for selecting a predetermined number of basic hand operation patterns and random access memory for storing the data necessary for the processing by the processing means, motor driving circuit for driving said motor means, input circuit for inputting said electrical signals from the melody circuit, and output circuit for outputting melody starting command signal to the melody circuit means to start playing music.

* * * * *